US006074050A

United States Patent [19]

Perez et al.

[11] Patent Number: 6,074,050

[45] Date of Patent: Jun. 13, 2000

[54] METHOD AND APPARATUS FOR VENTING AN INK CONTAINER

[75] Inventors: Raul Perez, Corvallis; Rhonda Wilson, Monmouth; Norman E. Pawlowski, Jr., Corvallis, all of Oreg.

[73] Assignee: Hewlett-Packard Company, Palo Alto, Calif.

[21] Appl. No.: 08/984,219

[22] Filed: Dec. 3, 1997

[51] Int. Cl.[7] ..... B41J 2/175

[52] U.S. Cl. ..... 347/86

[58] Field of Search ..... 347/85, 86, 87

[56] References Cited

U.S. PATENT DOCUMENTS

| | | | |
|---|---|---|---|
| 3,371,350 | 2/1968 | Sanderson et al. | 346/140.1 |
| 4,558,326 | 12/1985 | Kimura et al. | 347/30 |
| 4,568,954 | 2/1986 | Rosback | 347/86 |
| 5,233,369 | 8/1993 | Carlotta et al. | 347/87 |
| 5,329,294 | 7/1994 | Ontawar et al. | 397/87 |
| 5,515,663 | 5/1996 | Allgeier et al. | 397/87 |

FOREIGN PATENT DOCUMENTS

| | | | |
|---|---|---|---|
| 0488829A2 | 6/1992 | European Pat. Off. | B41J 2/175 |
| 0704308A1 | 4/1996 | European Pat. Off. | B41J 2/175 |
| 0712727A2 | 5/1996 | European Pat. Off. | B41J 2/175 |
| 5-318760 | 12/1993 | Japan . | |
| 08118676 | 5/1996 | Japan | B41J 2/175 |
| 08310003 | 11/1996 | Japan | B41J 2/175 |
| WO94/11194 | 5/1996 | WIPO | B41J 2/175 |

*Primary Examiner*—N. Le
*Assistant Examiner*—Michael Nghiem
*Attorney, Agent, or Firm*—Winthrop D. Childers; Kevin B. Sullivan

[57] ABSTRACT

Disclosed is a replaceable ink container for providing ink to an ink-jet printing system. The ink container includes a pressure vessel for pressurizing ink. The ink container has a non-operating state and an operating state. Within the operating state, the pressure vessel has an internal gauge pressure maintained within an operating range so that pressurized ink is provided to the printing system. The ink container also includes a gas vent apparatus communicating between an inside surface of the pressure vessel and an outside atmosphere to allow continuous venting in both the operating and non-operating states. In one preferred embodiment the vent apparatus includes a porous member that is located between a pressurized region of the ink container and an outside atmosphere. This porous member provides a flow path for gas therethrough.

15 Claims, 5 Drawing Sheets

METHOD AND APPARATUS FOR VENTING AN INK CONTAINER

BACKGROUND OF THE INVENTION

The present invention relates to ink-jet printing systems, and more particularly, ink-jet printing systems which make use of ink containers that are pressurized to allow for high printing rates.

Ink-jet printers frequently make use of an ink-jet printhead mounted to a scanning carriage which is moved back and forth across a print media, such as paper. The printhead includes an ejector portion that faces the print media. The ejector portion is responsive to signals from a control system associated with the printing system for selectively ejecting ink droplets onto the print media. The carriage scans the ejector across the print media to print a swath. The media is then advanced to allow printing of another swath. In this way, ink droplets deposited by successive swaths form images and text on print media.

It is important that the images formed on print media have high print quality. Print quality is determined to a large extent by the proper operation of the printhead. A printhead typically includes an internal reservoir that is in fluid communication with the ejector. Critical to the proper operation of the ejector portion is the fluid pressure of the ink within the internal reservoir relative to an atmospheric pressure referred to as gauge pressure. A pressure regulation means is usually included with the printhead to control the gauge pressure within the internal reservoir.

Previously, some printers have made use of ink containers that are separately replaceable from the printhead. When the ink container is exhausted, the ink container is removed and replaced. The use of such separately replaceable ink containers allows for printing until the end of printhead life.

Some printers have also made use of "off-carriage" ink containers, wherein the ink containers are located off the scanning carriage. These off-carriage ink containers are typically coupled fluidically to the printhead internal reservoir by a tube. The use of off-carriage ink containers tends to reduce carriage weight, allowing for a more compact carriage that requires less power for movement, hence, smaller carriage motors to provide carriage motion. U.S. Pat. No. 5,650,811 describes such a configuration including an ink container coupled to a tube that is in turn coupled to a pressure regulator associated with the printhead. The pressure regulator assures that the ejector portion of the printhead receives ink at the proper pressure.

To allow the regulator to properly control pressure, the printing system utilizes an ink container that provides pressurized ink to the printhead. Delivery of ink to the printhead at a pressure that is equal to or greater than the operational pressure of the printhead is essential to ensure proper printhead operation. The regulator, in turn, regulates the fluid pressure of ink provided to the ejector portion to ensure proper operation of the printhead. The use of a regulator and a pressurized ink supply allows for the compensation for various design, layout, and environmental factors such as pressure drops, relative heights of the printhead and the ink supply, and atmospheric pressure changes.

Previously used ink-jet printing systems have used pressurized ink for various reasons. Examples of ink-jet components or systems utilizing pressurized ink are described in U.S. Pat. No. 4,558,326 to Kimura et al and U.S. Pat. No. 4,568,954 to Rosback.

One problem associated with pressurized ink containers is the effect that the internal pressure has on the container materials. Replaceable ink containers are preferably manufactured from low cost materials, such as plastic. A sustained internal pressure can cause these materials to permanently deform. This deformation, if severe enough, may render the ink container unusable. One example of how the ink container may become unusable is when the deformation prevents the ink container from fitting into an ink container receiving slot within the ink jet printing system.

There is an ever present need for ink containers for use in pressurized off carriage ink jet printing systems. These ink containers should be capable of use without deformation or leaking. In addition, these containers need to have a low manufacturing cost to minimize the cost of ink usage.

SUMMARY OF THE INVENTION

The present invention is a replaceable ink container for providing ink to an ink-jet printing system. The ink container includes a pressure vessel for pressurizing ink. The ink container has a non-operating state and an operating state. Within the operating state, the pressure vessel has an internal gauge pressure maintained within an operating range so that pressurized ink is provided to the printing system. The ink container also includes a gas vent apparatus communicating between an inside surface of the pressure vessel and an outside atmosphere to allow continuous venting in both the operating and non-operating states.

In one preferred embodiment the vent apparatus includes a porous member that is located between a pressurized region of the ink container and an outside atmosphere. This porous member provides a flow path for gas therethrough.

DETAILED DESCRIPTION OF THE PREFERRED EMBODIMENT

Figure 1:
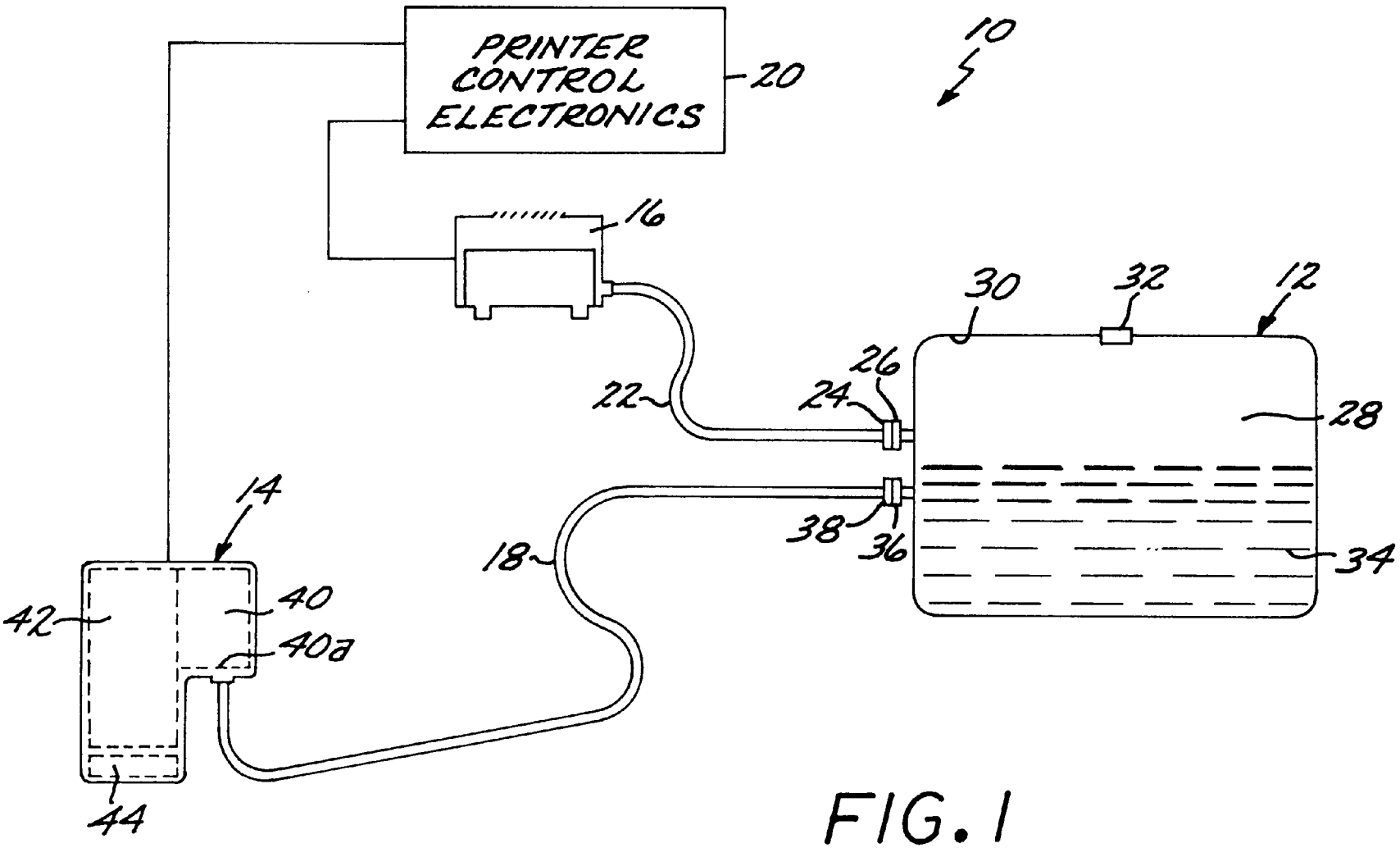
FIG. 1 depicts a schematic representation of a printing system that includes an ink container of the present invention which makes use of a pressurized gas source for delivering pressurized fluid to a printing system.

FIG. 1 is a schematic representation which depicts an ink-jet printing system 10 that includes ink container 12 of the present invention for providing pressurized ink to a printhead 14. Printing system 10 includes a pressure source 16 for pressurizing ink container 12. In response to pressurization, ink container 12 provides pressurized ink to printhead 14 by way of conduit 18. Printhead 14 selectively deposits ink on media (not shown) under control of printer electronics 20.

Pressure source 16 is coupled to ink container 12 via pressure conduit 22 to allow a flow of gas from pressure source 16 to ink container 12 in order to pressurize ink container 12. Pressure source 16 provides pressurized gas such as air to pressure conduit 22 in response to signals from printer control electronics 20. Pressure conduit 22 is coupled to gas outlet 24 that is in turn connected to gas inlet 26 associated with the ink container 12. Gas inlet 26 is coupled to pressure chamber 28 that is defined by an inside surface 30 of the ink container 12. Ink container 12 includes a venting apparatus 32 that establishes a gas flow path between pressure chamber 28 and an outside atmosphere to allow continuous venting of pressure chamber 28 at any time when a pressure difference exists between the pressure chamber 28 and the outside atmosphere.

Ink container 12 provides ink to printhead 14 via fluid conduit 18. Ink container 12 includes a supply of ink 34 that is fluidically coupled to a fluid outlet 36. Fluid outlet 36 is connected to fluid inlet 38 that is in turn coupled to a first end of fluid conduit 18. A second end of fluid conduit 18 is coupled to printhead 14.

Printhead 14 receives ink from conduit 18 and selectively deposits the ink on media (not shown). Printhead 14 includes a regulator portion 40, an internal reservoir 42, and an ejector portion 44. The regulator portion 40 regulates or controls the fluid pressure in the internal reservoir 42. In one embodiment, the regulator includes a valve 40*a* that is connected to conduit 18. Regulator 40 opens and closes valve 40*a* in response to pressure changes in internal reservoir 42 to maintain the proper gauge pressure in the internal reservoir 42. The internal reservoir 42 is fluidically coupled to ejector portion 44. In response to signals received from printer electronics 20, ejector portion 44 selectively deposits ink on media (not shown).

Figure 2:
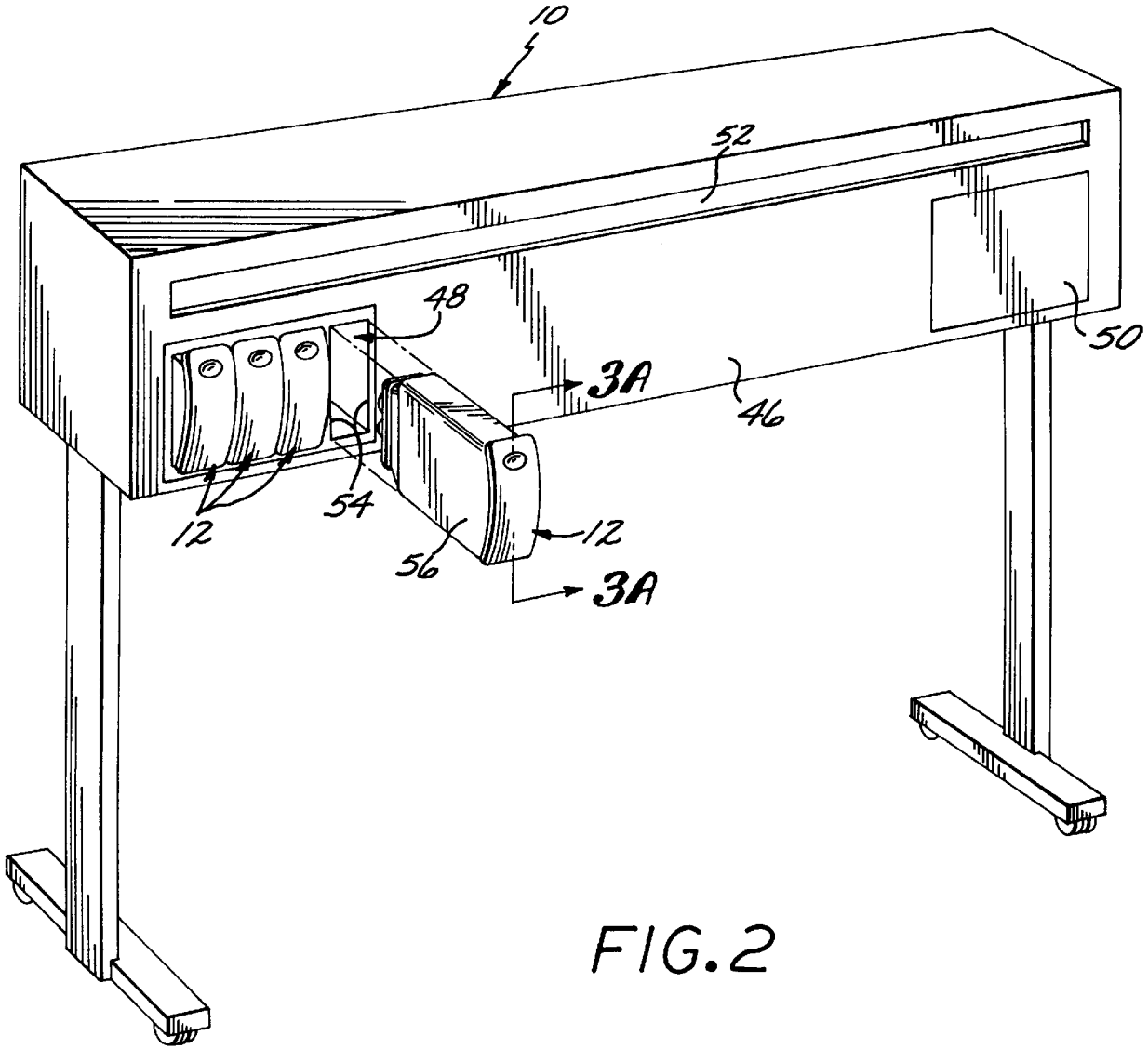
FIG. 2 is a representation, shown in perspective of a large format printing system that utilizes ink containers of the present invention.

FIG. 2 depicts a representation of one embodiment of the printing system 10. The printing system 10 includes a printing chassis 46 containing one or more ink containers 12 of the present invention that are slidably mountable in one of a plurality of receiving slots 48. The embodiment illustrated in FIG. 2 is configured to receive four ink containers 12 with each ink container 12 containing a different ink color. In the case of four color printing each of the four ink containers 12 contain a different ink color, such as one of cyan, yellow, magenta, and black inks. Each of the four inks are provided to one or more printheads 14 that in turn selectively deposit ink on print media such as paper. The printer chassis 46 also includes a control panel 50 for controlling operation of the printing system 10 and a media slot 52 from which print media is ejected.

The preferred ink container 12 of the present invention provides pressurized ink to printhead 14. Ink container 12 in this embodiment is slidably mounted in the receiving slot 48. The receiving slot 48 is defined, at least partially, by a pair of sidewalls 54. For the case where the ink container 12 is deformable, pressurization of the ink container 12 can produce an outward extension or bulging of a pair of sides 56 that define the ink container 12. If an ink container 12 is pressurized for an excessive time period, the ink container 12 can take on a permanent deformation. This deformation, if severe enough, can prevent the ink container 12 from fitting between the sidewalls 54 making insertion and removal of the ink container 12 difficult. The venting apparatus 32 of the present invention assures that the internal pressure is relieved to prevent permanent deformation of ink container 12.

Figure 3B:
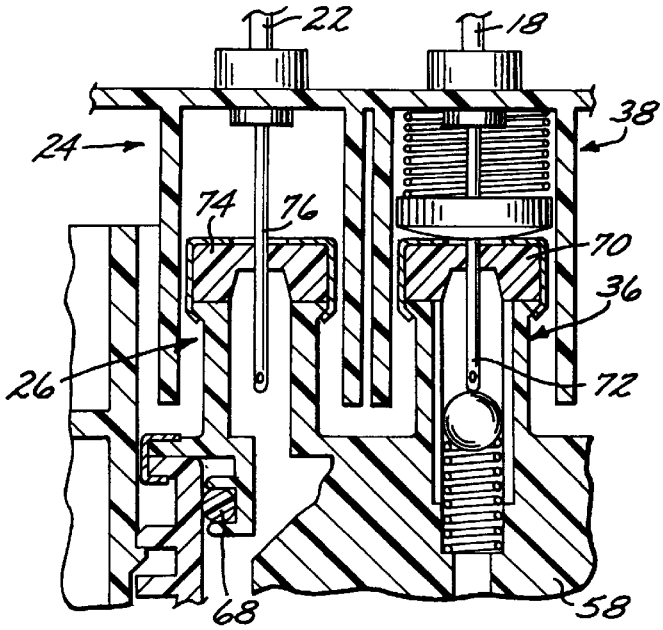
FIG. 3B is a cross section of the fluid and air connectors of FIG. 3A shown connected to the printing system.
Figure 3A:
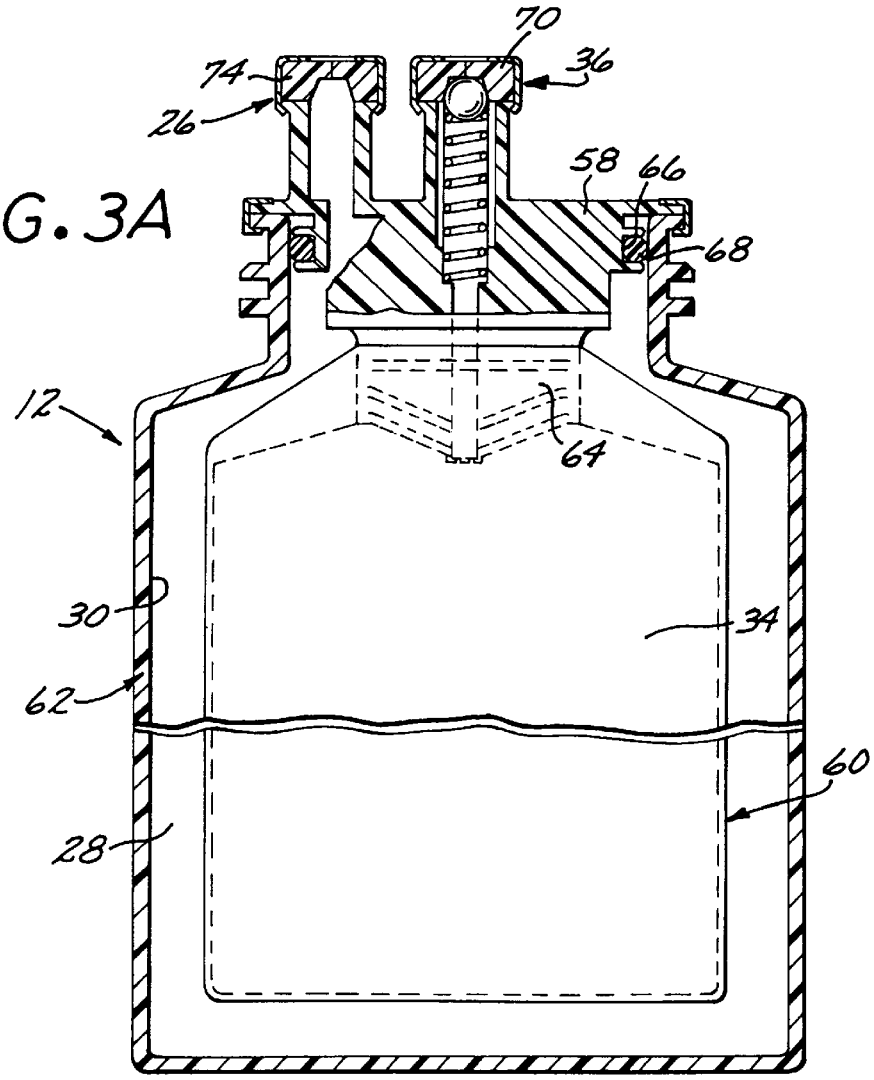
FIG. 3A is a cross sectional representation of the ink container of the present invention taken through section line 3A—3A of FIG. 2.

FIG. 3A depicts a preferred embodiment of ink container 12 taken across line 3A—3A of FIG. 2. Ink container 12 as illustrated in FIG. 3A includes a chassis 58, a collapsible reservoir 60, and a pressure vessel 62. Referring to FIG. 1, like elements are indicated by like numbers. However, the embodiment of ink container 12 illustrated in FIG. 1 has ink in direct contact with the inner wall of ink container 12. In contrast, FIG. 3A depicts an ink container 12 having a collapsible reservoir 60 containing the ink and surrounded by the pressure vessel 62. Also unlike FIG. 1, the version in FIG. 3A utilizes the chassis 58.

The chassis 58 provides a number of functions. It includes the fluid outlet 36 and provides fluid communication between the fluid outlet 36 and the collapsible reservoir 60. The chassis 58 includes the gas inlet 26 that is in fluid communication with the pressure chamber 28. Pressure chamber 28 is defined by an outside surface of the collapsible reservoir 60 and an inside surface 30 of the pressure vessel 62.

The collapsible reservoir 60 is preferably a collapsible film bag containing a supply of ink 34. The bag has an opening at one end that is sealed to bag sealing surfaces 64 formed on the chassis 58.

In one preferred embodiment, pressure vessel 62 is a bottle-shaped enclosure that is fabricated from polyethylene. It is designed to provide pressures equal to about 2 PSI (pounds per square inch) for pressurizing the supply of ink 34. However, sustained pressures in chamber 28 can cause pressure vessel 62 to permanently deform. When pressurization occurs during printing system use, sidewalls 54 (see FIG. 2) provide some support to help prevent permanent deformation of pressure vessel 62. Pressure vessel 62 is attached to chassis 58 proximate to a vessel sealing surface 66. In a preferred embodiment, the sealing between the pressure vessel 62 and chassis 58 is provided by O-ring 68.

Ink container 12 is adapted to be releasably installed into a receiving slot 48 (FIG 2). When ink container 12 is installed, fluidic and air connections are established, as indicated by FIG. 1 and shown greatly enlarged in FIG. 3B. FIG. 3B illustrates the fluid outlet 36 and the gas inlet 26 as shown in FIG. 3A connected to the printing system 10. A fluidic connection is established between fluid outlet 36 associated with ink container 12 and fluid inlet 38 associated with receiving slot 48, providing fluid communication between the ink supply 34 and printhead 14. In this example, the fluid outlet 36 comprises a fluid septum 70 for sealing the fluid outlet 36. The fluid inlet 38 comprises a hollow needle 72 that is fluidically connected to fluid conduit 18 associated with the printing system 10.

When ink container 12 is installed in receiving slot 48, a connection is established between the gas inlet 26 associated with the ink container 12 and the gas outlet 24 associated with the printing system 10 for providing fluid communication between pressure source 16 and pressure chamber 28. In this example, gas inlet 26 comprises a gas septum 74. The gas outlet 24 comprises a hollow needle 76 that is coupled to pressure conduit 22.

Figure 4A:
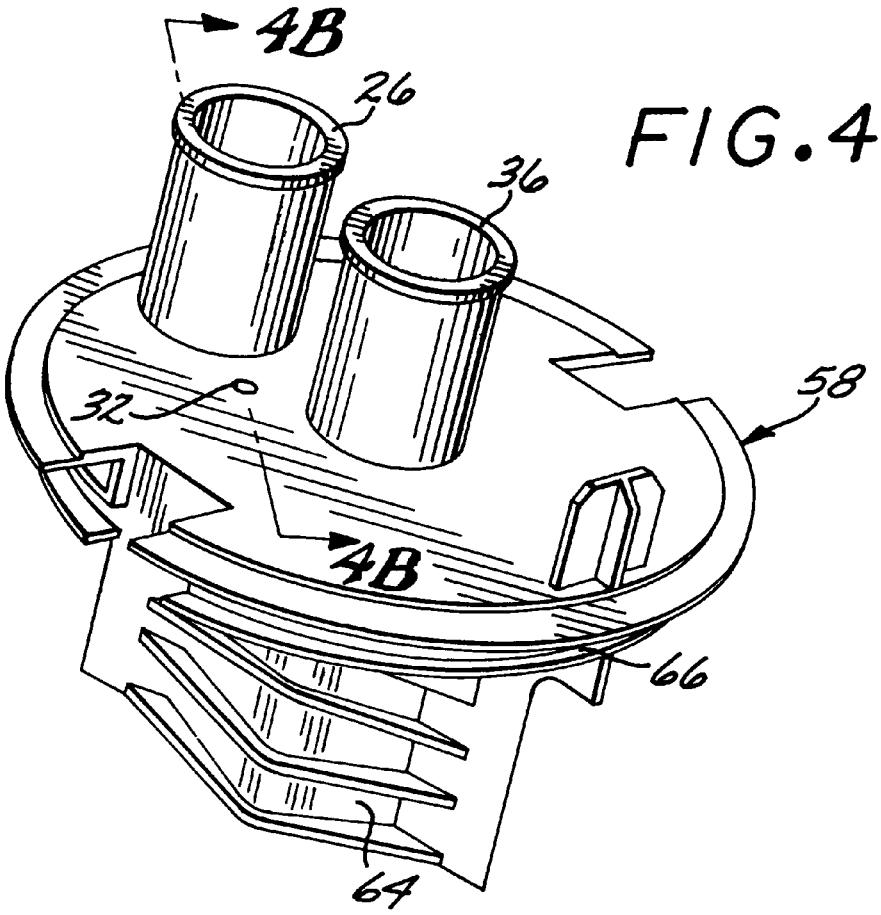
FIGS. 4A–4D depicts a preferred embodiment of a chassis that includes a vent apparatus of the present invention.

Turning to FIG. 4A, the preferred embodiment of the chassis 58 is shown. In addition to providing the aforementioned functions, the chassis also includes a vent apparatus 32. Vent apparatus 32 communicates between an outer surface of chassis 58 and pressure chamber 28.

Figure 4B:
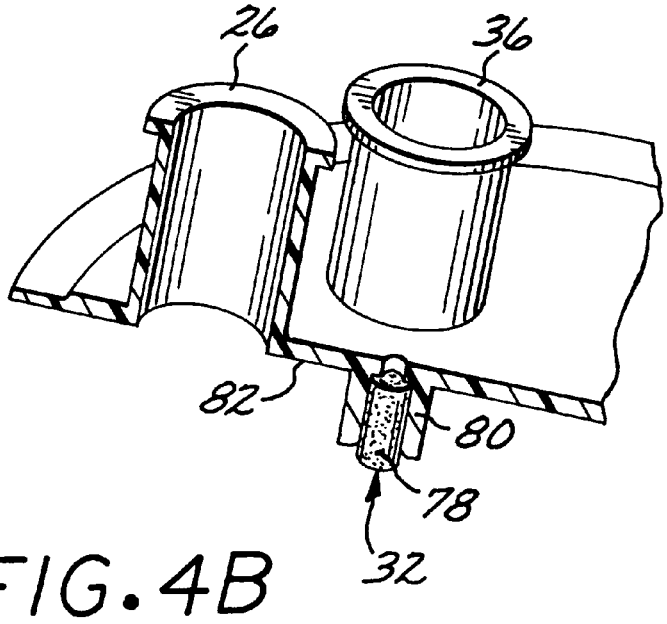

FIG. 4B illustrates a cutaway view of chassis 58 illustrating the preferred embodiment of vent apparatus 32 in cross section. Vent apparatus 32 includes a porous or gas permeable member 78 that connects between pressure chamber 28 and an outside atmosphere. In a preferred embodiment, vent apparatus 32 includes a housing 80 extending from an inside surface 82 of chassis 58. Porous member 78 is supported by housing 80.

Porous member 78 is preferably formed from an injection molded porous polyethylene. An example of this material is sold under the trade name POREX™, manufactured by Porex Technologies of Fairburn Ga. The flow rate characteristics of porous member 78 are determined primarily by the material pore size and secondarily by the compression of porous member 78 by housing 80. As the pore size increases, the flow restriction and fluid resistance decreases. The compression has the effect of reducing pore size, increasing flow restriction. For a preferred embodiment, porous member 78 has an 18–40 micron pore size.

In an preferred embodiment, the vent apparatus 32 is specified to provide an air flow rate of approximately 3 cc/min (cubic centimeters per minute) measured at STP (standard temperature and pressure) with a pressure difference of 2.5 PSI (pounds per square inch) between pressure chamber 28 and an outside atmosphere. However, the preferred flow rate may vary, depending on the volume of the container, the sensitivity of the container vessel 62 to permanent deformation, and the rate at which gas pressure source 16 (shown in FIG. 1) pressurizes pressure chamber 28.

In a preferred embodiment, porous member 78 provides a barrier to liquid passing between chamber 28 and the outside atmosphere. This is accomplished by incorporating a conventional absorbent material such as powdered clay into the plastic used to form porous member 78. When a liquid contacts porous member 78, the absorbent material swells, closing off the pores in porous member 78.

Figure 4C:
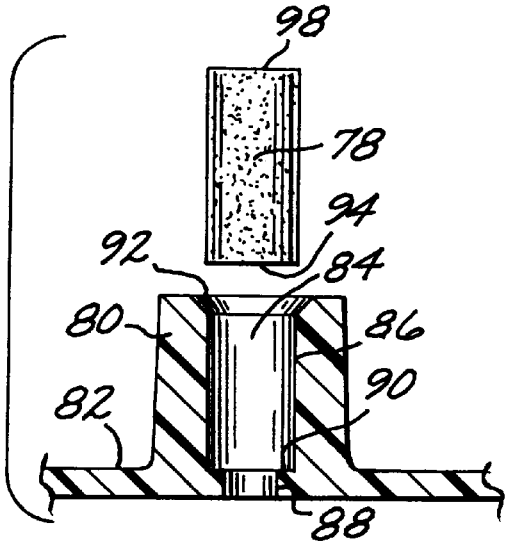
Figure 4D:
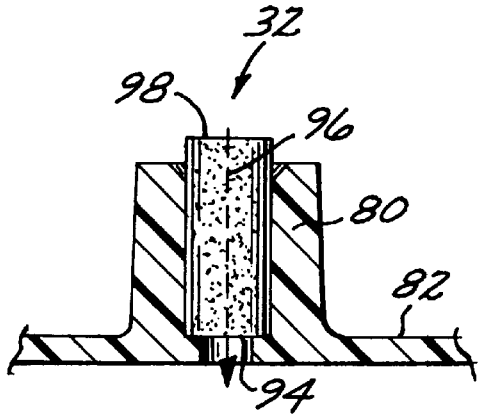

A cross section of vent apparatus 32 in unassembled and assembled states is shown in FIGS. 4C and 4D, respectively. As shown in FIG. 4C, vent apparatus 32 includes a cylindrical compound bore 84 having a wider diameter section 86 and a narrower diameter section 88. The transition between the wider and narrower diameter provides a radial shoulder 90. The larger diameter section includes a leading tapered section 92.

As indicated in FIG. 4C, the venting apparatus 32 is formed by inserting cylindrical porous member 78 into the compound bore 84. The leading tapered section 92 helps to guide the porous member 78 into the wider diameter section 86. The porous member 78 is pressed into the compound bore until a leading end 94 reaches the radial shoulder 90. As the porous member 78 is installed into the larger diameter section 86, it is radially compressed, insuring a secure seal between porous member 78 and the inner wall of the larger diameter section 86.

FIG. 4D depicts the assembled state of vent apparatus 32. Porous member 78 defines a gas flow path 96 between the pressure chamber 28 and an outside atmosphere. The narrow diameter section 88 of the compound bore 84 provides communication between the leading end 94 of the porous member 78 and the outside atmosphere. A trailing end 98 of the porous member 78 extends into the chamber 28. Housing 80 extends a distance above the inside surface 82 to allow vent apparatus 32 to tolerate a certain amount of fluid accumulation along the inside surface 82 without occluding the vent apparatus 32.

Alternatively, porous member 78 can be fabricated of sintered metal. Sintered metal will behave similarly functionally and would be used similarly as discussed with respect to FIGS. 4C and 4D. Sintered metal has small pores that gas or air can pass through, but holds back fluid at a pressure that increases inversely with the pore size.

Venting apparatus 32 could also be fabricated as one or more labyrinth-shaped (spiral, serpentine, tortuous, etc.) passageways with a controlled opening size that communicate between pressure chamber 28 and outside atmosphere. The quantity, opening size, length, and bend geometry of the passageways can be adjusted to provide a given degree of air flow and fluid flow restriction.

Venting apparatus 32 has been described with respect to FIGS. 4A–D as being incorporated into chassis 58. However, vent apparatus 32 may be incorporated into any other location on ink container 12 that provides a gas flow path between the pressure chamber 28 and outside the atmosphere. For example, FIG. 1 illustrates vent apparatus 32 as being incorporated into an outer wall of ink container 12 such as the pressure vessel 62.

The manufacture of the ink container 12 includes assembling the ink container components and filling the ink container with ink. Filling is typically done by providing ink to fluid outlet 36. Referring to FIG. 1, it can be seen that as ink is introduced, air in chamber 28 will tend to be compressed and will pressurize. By virtue of vent 32, this air can escape. Thus, vent 32 has a benefit that it relieves any pressure left over from the initial ink fill process.

When ink container 12 is assembled, pressure chamber 28 will typically take on a pressure equal to that of an outside atmosphere. If ink container 12 is transported by aircraft or transported to a geographic region having a higher altitude, a pressure difference will exist between pressure chamber 28 and the outside atmosphere. This pressure difference can reach 5 PSI or higher during normal transportation of the ink container. If this pressure difference exists for as little as 2–3 hours, the walls of pressure vessel 62 can be permanently deformed. This deformation, if severe enough, may prevent ink container 12 from being installed into receiving slot 48 (FIG. 2). Vent apparatus 32 of the present invention prevents this permanent deformation, by dissipating the pressure within the pressure vessel 62.

Prevention of the permanent deformation establishes a minimum flow rate for vent apparatus 32. For an exemplary design, the minimum flow rate is about 1 cc (cubic centimeter) air per minute at STP (standard temperature and pressure) with a pressure difference (between the pressure chamber 28 and an outside atmosphere) of 2.5 PSI (pounds per square inch). For small containers with less resilient pressure vessels, the minimum could be 0.1 cc air per minute (same conditions) or lower. The minimum flow rate will in general depend on various factors, such as container volume, pressure vessel material, to name a few.

In operation, the ink container 12 is initially installed into receiving slot 48 such that fluid outlet 36 engages fluid inlet 38 to establish a fluidic connection between ink supply 34 and fluid conduit 18. Insertion of ink container 12 also couples air inlet 26 with air outlet 24 associated with the printing system to establish communication between pressure conduit 22 and pressure chamber 28.

Initially, the ink container 12 is a non-operating state where ink is not provided to the printing system 10 at the proper pressure. To reach an operating state, pressure vessel 62 must be pressurized to a proper level. Pressure source or air pump 16 begins supplying gas to pressure chamber 28 via pressure conduit 22 to provide a positive internal gauge pressure in pressure chamber 28. At the same time, vent apparatus 32 is relieving pressure from pressure chamber 28. It is important that vent apparatus 32 relieve pressure slowly enough such that pressure source 16 pressurizes chamber 28 at an acceptable rate.

The pressurization requirement sets a maximum flow rate for vent apparatus 32. For an exemplary design, the maximum flow rate is specified as 5 cc per minute (air at STP) with an internal gauge pressure of 2.5 PSI. However, depending on the time requirement for pressurizing the ink container 12 and the flow rate generated by the pressure source 16, the acceptable flow rate could be 50 cc per minute or higher (air at STP) with an internal gauge pressure of 2.5 PSI.

Once the internal gauge pressure (in pressure chamber 28) reaches a predefined range, referred to as an operating pressure range, the ink container 12 is in an operating state. Printing system 10 then selectively provides energization signals to printheads 14 for selectively depositing ink on media. For typical systems, this gauge pressure should be in the 0.5 to 3.0 pounds per square inch range. In one preferred embodiment, the gauge pressure should be in the range of 1.0 to 2.0 pounds per square inch. Ink flows from ink supplies 34, through fluid conduits 18, and to printheads 14 to replenish printheads 14. For the printing system of FIG. 1, each of printheads 14 contains a pressure regulator 40 for adjusting or regulating the pressure between conduit 18 and the reservoir 42 for allowing proper operation of ejector portion 44.

During printing, the internal pressure in pressure chambers 28 are maintained within a predetermined range that assure the required ink flow rates from ink supplies 34 to printheads 14. This may be done by regulating the pressure delivered from pump 16. Alternatively, pump 16 may be turned on and off to maintain the proper pressure range.

When printing is finished, pump 16 is turned off. At this point, vent 32 allows the pressure in pressure chamber 28 to dissipate. However, the decay rate of pressure is low enough such that if printing again starts within a specified time, then the internal gauge pressure of pressure chamber 28 will be at a high enough level to begin printing. Thus, it is preferable that the flow rate be low enough such that the pressure chamber maintain at least half of the operating gauge pressure in pressure chamber 28 for at least 5 seconds after the pump is turned off. However, to avoid deformation of pressure vessel 62, it would be preferable to have at least half of the operating pressure dissipated within 5 hours.

When the ink container 12 is removed from the printing system, the vent apparatus allows it to depressurize, to prevent aforementioned deformation of ink container 12. Thus, the ink container may be removed and replaced before it runs out of ink without problems with reinserting ink container 12 into printing system 10.

What is claimed is:

1. An ink container for providing ink to an ink-jet printing system, the ink container comprising:

a pressure vessel having a non-operating state and an operating state, during the operating state the pressure vessel has an internal gauge pressure that is treater than atmospheric pressure exterior to the pressure vessel and is maintained within an operating range so that pressurized ink is provided to the printing system from the pressure vessel, during the non-operating state ink is not provided from the pressure vessel to the printing system; and a vent apparatus communicating between an inside surface of the pressure vessel and outside atmosphere, the vent apparatus including a venting mechanism providing continuous venting of the internal gauge pressure in both the operating and the non-operating states.

2. The ink container of claim 1 wherein the venting mechanism restricts a flow of gas therethrough such that at least half of the pressure vessel internal gauge pressure is maintained for at least 5 seconds when the ink container is not connected to a pressure source.

3. The ink container of claim 1, wherein the venting mechanism allows a flow of gas at a sufficient rate such that at least half of the pressure vessel internal gauge pressure is relieved within 5 hours when the ink container is not connected to a pressure source.

4. The ink container of claim 1, wherein a flow rate through the venting mechanism is in the range of 0.1 to 50 cubic centimeters of air per minute measured at standard temperature and pressure when an internal gauge pressure of 2.5 pounds per square inch exists in the pressure vessel.

5. The ink container of claim 1, wherein a flow rate through the venting mechanism is in the range of 1 and 5 cubic centimeters of air per minute measured at standard temperature and pressure when an internal gauge pressure of 2.5 pounds per square inch exists in the pressure vessel.

6. The ink container of claim 1, wherein the venting mechanism comprises a porous member that defines a gas flow path between a pressurized region of the pressure vessel and an outside atmosphere.

7. The ink container of claim 1, wherein the venting mechanism comprises a porous member that defines a flow path for gas from an inside of the pressure vessel to outside atmosphere.

8. An ink container for providing ink to an ink-jet printing system, the ink container comprising:

a pressure vessel having a non-operating state and an operating state, during the operating state the pressure vessel has an internal gauge pressure that is greater than atmospheric pressure exterior to the pressure vessel and is maintained within an operating range so that pressurized ink is provided to the printing system from the pressure vessel, during the non-operating state ink is not provided from the pressure vessel to the printing system; and vent means for venting of the internal gauge pressure in both the operating and the non-operating states.

9. An ink container, comprising:

a pressure vessel containing ink and having a gas inlet through which ink in the pressure vessel is pressurized, the pressure vessel having an operating state, wherein the pressure vessel has an internal gauge pressure that is greater than atmospheric pressure exterior to the pressure vessel and is maintained within an operating range so that the ink is provided under pressure from the pressure vessel to the printing system and a non-operation state, wherein the ink is not provided from the pressure vessel to the printing system; and a porous member communicating between an inside surface of the pressure vessel and outside atmosphere, the porous member providing venting of the internal gauge pressure in both the operating and the non-operating states.

10. The ink container of claim 9, wherein the pressure vessel has an outer surface that defines an orifice, and wherein the porous member is positioned in the orifice.

11. The ink container of claim 10, wherein the porous member is compressed by the orifice.

12. The ink container of claim 9, wherein the porous member comprises polyethylene.

13. A printing system, comprising:

a printhead for selectively depositing ink on media;

a supply of ink that is fluidically coupled to the printhead;

a pressure vessel surrounding the supply of ink, the pressure vessel having an operating state, wherein the pressure vessel has an internal gauge pressure that is greater than atmospheric pressure exterior to the pressure vessel and is maintained within an operating range so that the ink is provided under pressure from the supply of ink to the printhead, and a non-operating state, wherein the ink is not provided from the supply of ink to the printhead;

a gas pressure source coupled to the pressure vessel, the gas pressure source supplying the internal gauge pressure for depositing ink on media; and a venting apparatus including a vent mechanism providing continuous venting of the internal gauge pressure from the pressure vessel to an outside atmosphere in both the operating and non-operating states.

14. The printing system of claim 13, wherein the vent mechanism is a porous member.

15. The printing system of claim 13, wherein the supply of ink and the venting apparatus are integral to an ink container.

* * * * *

UNITED STATES PATENT AND TRADEMARK OFFICE

CERTIFICATE OF CORRECTION

PATENT NO :6,074,050

DATED :June 13, 2000

INVENTOR(S) :Raul Perez, et al.

It is certified that error appears in the above-identified patent and that said Letters Patent are hereby corrected as shown below:

At column 7, line 46, after "that is", delete "treater" and insert in lieu thereof --greater--.

Signed and Sealed this

First Day of May, 2001

*Attest:*

Nicholas P. Godici

NICHOLAS P. GODICI

*Attesting Officer*

*Acting Director of the United States Patent and Trademark Office*